US008283298B2

(12) United States Patent
Krull et al.

(10) Patent No.: US 8,283,298 B2
(45) **Date of Patent: *Oct. 9, 2012**

(54) MINERAL OILS WITH IMPROVED CONDUCTIVITY AND COLD FLOWABILITY

(75) Inventors: Matthias Krull, Harxheim (DE); Werner Reimann, Frankfurt (DE)

(73) Assignee: Clariant Produkte (Deutschland) GmbH, Frankfurt am Main (DE)

( * ) Notice: Subject to any disclaimer, the term of this patent is extended or adjusted under 35 U.S.C. 154(b) by 944 days.

This patent is subject to a terminal disclaimer.

(21) Appl. No.: 11/494,951

(22) Filed: Jul. 28, 2006

(65) Prior Publication Data

US 2007/0027041 A1 Feb. 1, 2007

(30) Foreign Application Priority Data

Jul. 28, 2005 (DE) ..... 10 2005 035 275

(51) Int. Cl.

| | |
|---|---|
| ***C09K 15/08*** | (2006.01) |
| ***C08K 5/13*** | (2006.01) |
| ***C07C 309/62*** | (2006.01) |
| ***C10L 1/18*** | (2006.01) |
| ***C10L 1/22*** | (2006.01) |

(52) U.S. Cl. ..... 508/585; 508/390; 44/300; 44/397; 44/412; 44/450; 252/500; 252/510

(58) Field of Classification Search ..... 508/390, 508/585; 44/300, 397, 412; 252/500, 510
See application file for complete search history.

(56) References Cited

U.S. PATENT DOCUMENTS

| | | | | |
|---|---|---|---|---|
| 3,917,466 | A * | 11/1975 | Henry, Jr. | 44/351 |
| 4,211,534 | A | 7/1980 | Feldman | |
| 4,356,002 | A | 10/1982 | Knepper | |
| 4,430,202 | A * | 2/1984 | Bloess | 208/187 |
| 4,537,601 | A | 8/1985 | Naiman | |
| 4,613,342 | A * | 9/1986 | Dorer et al. | 44/334 |
| 4,670,516 | A | 6/1987 | Sackmann | |
| 5,039,437 | A | 8/1991 | Martella | |
| 5,089,589 | A | 2/1992 | Hesse | |
| 5,186,720 | A | 2/1993 | Feustel | |
| 5,391,632 | A | 2/1995 | Krull | |
| 5,707,946 | A | 1/1998 | Hiebert | |
| 5,766,273 | A | 6/1998 | Dralle-Voss | |
| 5,851,429 | A | 12/1998 | Magyar | |
| 5,998,530 | A | 12/1999 | Krull et al. | |
| 6,071,993 | A | 6/2000 | Wenderoth et al. | |
| 6,358,895 | B1 * | 3/2002 | Phillips | 508/433 |
| 2001/0048099 | A1 | 12/2001 | Schield | |
| 2005/0000151 | A1 | 1/2005 | Jackson | |
| 2005/0005507 | A1 | 1/2005 | Krull et al. | |
| 2005/0016060 | A1 * | 1/2005 | Krull et al. | 44/418 |
| 2005/0039384 | A1 | 2/2005 | Gormley | |
| 2006/0020065 | A1 | 1/2006 | Krull et al. | |
| 2007/0027040 | A1 | 2/2007 | Krull et al. | |
| 2007/0027041 | A1 | 2/2007 | Krull et al. | |

FOREIGN PATENT DOCUMENTS

| | | | |
|---|---|---|---|
| CA | 2017126 | | 11/1990 |
| DE | 19622052 | A1 | 12/1997 |
| EP | 0 061 894 | | 10/1982 |
| EP | 0271738 | A2 | 6/1988 |
| EP | 0311452 | A2 | 4/1989 |
| EP | 0857776 | A1 | 8/1998 |
| EP | 0964052 | A1 | 12/1999 |
| EP | 1500691 | A2 | 1/2005 |
| EP | 1502938 | A1 | 2/2005 |
| EP | 1621600 | A2 | 2/2006 |
| EP | 1640438 | A1 | 3/2006 |
| WO | WO 03/042336 | A2 | 5/2003 |
| WO | WO 03/106595 | A2 | 12/2003 |

OTHER PUBLICATIONS

Roempp Chemie Lexikon, 9th Ed., (1988-1992) vol. 4, pp. (3351-3354).
European Search Report for EPO6 01 3804, dated Aug. 5, 2009.
"Aviation Fuels Technical Review", Chevron Corporation, Internet Citation, Jan. 1, 2006, 96 pages.
English Abstract for EP0271738 A2, publication date Jun. 22, 1988.
English Abstract for EP0964052 A1 , publication date Dec. 15, 1999.

* cited by examiner

*Primary Examiner* — Cephia D Toomer
*Assistant Examiner* — Vishal Vasisth
(74) *Attorney, Agent, or Firm* — Tod A. Waldrop

(57) ABSTRACT

Mineral oil distillates having an aromatics content of less than 21% by weight, a water content of less than 150 ppm and a conductivity of at least 50 pS/m, and comprising from 0.1 to 200 ppm of at least one alkylphenol-aldehyde resin (constituent I) which includes a structural element of the formula

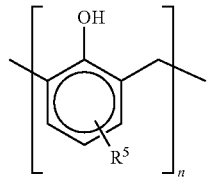

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl and n is from 2 to 100, and from 0.1 to 200 ppm of at least one polar oil-soluble nitrogen compound (constituent II), excluding those mineral oil distillates in which between 0.001 and 10 ppm of an oil-soluble, organic sulfonic acid-ammonium salt are present.

17 Claims, No Drawings

MINERAL OILS WITH IMPROVED CONDUCTIVITY AND COLD FLOWABILITY

The present invention relates to the use of alkylphenol-aldehyde resins and oil-soluble polar nitrogen compounds for improving the conductivity of low-water mineral oil distillates, and to the additized mineral oil distillates.

In the face of increasingly strict environmental legislation, the content of sulfur compounds and aromatic hydrocarbons in mineral oil distillates is having to be lowered ever further. However, in the refinery processes used to produce on-spec mineral oil qualities, other polar and aromatic compounds are simultaneously also removed. Often, the uptake capacity of the oils for water is also reduced. As a side effect, this greatly lowers the electrical conductivity of these mineral oil distillates. As a result of this, electrostatic charges, as occur especially under high flow rates, for example in the course of pumped circulation in pipelines and filters in the refinery, in the distribution chain and in the consumer's equipment, cannot be dissipated. However, such potential differences between the oil and its environment harbor the risk of spark discharge which can lead to self-ignition or explosion of the highly inflammable liquids. Additives which increase the conductivity and facilitate the potential dissipation between the oil and its environment are therefore added to such oils with low electrical conductivity. What is particularly problematic in this context is the increase in the electrical conductivity at low temperatures, since the conductivity of organic liquids decreases with falling temperature and the known additives also show the same temperature dependence. A conductivity of more than 50 pS/m is generally considered to be sufficient for safe handling of mineral oil distillates. Processes for determining the conductivity are described, for example, in DIN 51412-T02-79 and ASTM 2624.

One compound class used for various purposes in mineral oils is that of alkylphenol resins and derivatives thereof, which can be prepared by condensation of phenols bearing alkyl radicals with aldehydes under acidic or basic conditions. For example, alkylphenol resins are used as cold flow improvers, corrosion inhibitors and asphalt dispersants, and alkoxylated alkylphenol resins as demulsifiers in crude oils and middle distillates. In addition, alkylphenol resins are used as stabilizers for jet fuel. Equally, resins of benzoic esters with aldehydes or ketones are used as cold additives for fuel oils.

A further group of mineral oil additives is that of polar oil-soluble nitrogen compounds which are added especially to winter diesel fuels as paraffin dispersants and counteract sedimentation of the paraffin crystals which precipitate out under cold conditions.

EP-A-0 857 776 discloses the use of alkylphenol resins in combination with ethylene copolymers and nitrogen-containing paraffin dispersants to improve the cold properties of middle distillates.

U.S. Pat. No. 4,356,002 discloses the use of oxyalkylated alkylphenol resins as antistats for hydrocarbons. With amino-bearing copolymers of maleic anhydride and α-olefins, these lead to synergistically improved conductivity. The formulation of additive concentrates from theses two substance classes presents difficulties in that they are barely miscible and thus form multiphasic systems.

Most of the commercially used conductivity improvers comprise metal ions and/or polysulfones as the active component. Polysulfones are copolymers of $SO_2$ and olefins. However, ash-forming and sulfur-containing additives are fundamentally undesired for use in low-sulfur fuels. The activity of the polar oil-soluble nitrogen compounds known as a further additive component as lubricity improvers is insufficient on its own and becomes, like the combination of these polar oil-soluble nitrogen compounds with oxyalkylated alkylphenol resins according to U.S. Pat. No. 4,356,002 too, ever more unsatisfactory with decreasing aromatics and water content of the oils to be additized. In the case of such oils, though, subsequent addition of water leads only to the dispersion of undissolved water, which does not contribute to an increase in the conductivity but rather leads to increased corrosive action and, under cold conditions, harbors the risk of ice formation and resulting blockages of conveying lines and filters.

It is thus an object of the present invention to find an additive, superior in its activity over the prior art, for improving the electrical conductivity of mineral oil distillates with low water content, especially of low-aromatics mineral oil distillates, which additionally ensures safe handling of these oils even at low temperatures. In order to leave behind no residues in the combustion, the additive should combust ashlessly and in particular not comprise any metals. Moreover, it should not comprise any sulfur compounds.

It has now been found that, surprisingly, the electrical conductivity of low-water mineral oils can be improved significantly by addition of small amounts of phenol resins (constituent I) and polar oil-soluble nitrogen compounds (constituent II). The conductivity is increased to a significantly greater extent by the combination of these two additive components than would be expected from the effect of the individual substances. In addition, the conductivity remains constant with falling temperature and even rises with falling temperature in many cases. The oils thus additized exhibit a greatly increased conductivity and can therefore be handled substantially more safely especially at low temperatures.

The invention thus provides for the use of compositions comprising at least one alkylphenol-aldehyde resin (constituent I) which contains a structural element of the formula

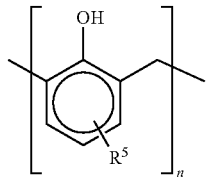

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and, based on the alkylphenol-aldehyde resin or the alkylphenol-aldehyde resins, comprise from 0.1 to 10% by weight of at least one polar oil-soluble nitrogen compound (constituent II), for improving the electrical conductivity of mineral oil distillates having a water content of less than 150 ppm, in such an amount that the mineral oil distillates have a conductivity of at least 50 pS/m.

The invention further provides a process for improving the electrical conductivity of mineral oil distillates having a water content of less than 150 ppm, by adding to the mineral oil distillates compositions comprising at least one alkylphenol-aldehyde resin (constituent I), which contains a structural element of the formula

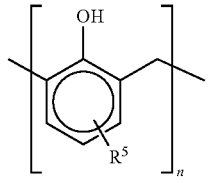

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and, based on the alkylphenol-aldehyde resin or the alkylphenol-aldehyde resins, from 0.1 to 10 parts by weight of at least one polar, oil-soluble nitrogen compound (constituent II), so that the mineral oil distillates have a conductivity of at least 50 pS/m.

The invention further provides a process for improving the electrical conductivity of mineral oil distillates having a water content of less than 150 ppm, and comprising from 0.1 to 200 ppm of at least one polar, oil-soluble nitrogen compound by adding to the mineral oil distillates from 0.1 to 200 ppm of at least one alkylphenol-aldehyde resin, which contains a structural element of the formula

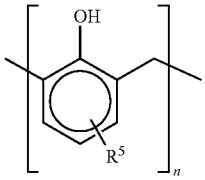

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, so that the mineral oil distillates have a conductivity of at least 50 pS/m.

The invention further provides for the use of at least one alkylphenol-aldehyde resin (constituent I) which contains a structural element of the formula

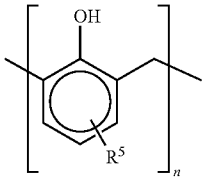

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, to improve the electrical conductivity of mineral oil distillates having a water content of less than 150 ppm, and comprising from 0.1 to 200 ppm of at least one polar, oil-soluble nitrogen compound (constituent II) in such an amount that the mineral oil distillates have a conductivity of at least 50 pS/m.

The invention further provides mineral oil distillates which have an aromatic content of less than 21 wt %, a water content of less than 150 ppm and a conductivity of at least 50 pS/m, and comprise from 0.1 to 200 ppm of at least one alkylphenol-aldehyde resin (constituent I), which contains a structural element of the formula

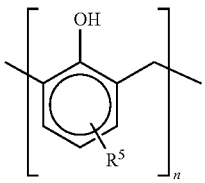

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and from 0.1 to 200 ppm of at least one polar oil-soluble nitrogen compound (constituent II).

In the context of the present invention, alkylphenol-aldehyde resins are understood to mean all polymers which are obtainable by condensation of a phenol bearing alkyl radicals with aldehydes or ketones. The alkyl radical can be bonded to the aryl radical of the phenol directly via a C—C bond or else via functional groups such as ethers or esters.

The inventive compositions, based on the alkylphenol resin or the alkylphenol-aldehyde resins, preferably comprise from 0.2 to 6 parts by weight and especially from 0.3 to 3 parts by weight of at least one polar, oil-soluble nitrogen compound.

Preference is given to using from 0.2 to 100 ppm and especially from 0.25 to 25 ppm for example from 0.3 to 10 ppm, of at least one alkylphenol-aldehyde resin and from 0.2 to 50 ppm and especially from 0.25 to 25 ppm, for example from 0.3 to 20 ppm, of at least one polar, oil-soluble nitrogen compound to improve the electrical conductivity. Particular preference is given to using a total of up to 100 ppm, preferably from 0.2 to 70 ppm and especially from 0.3 to 50 ppm of the combination of alkylphenol-aldehyde resin or alkylphenol-aldehyde resins and polar, oil-soluble nitrogen compound or nitrogen compounds.

The inventive mineral oil distillates preferably comprise from 0.2 to 100 ppm and especially from 0.25 to 25 ppm for example from 0.3 to 10 ppm, of at least one alkylphenol-aldehyde resin and from 0.2 to 50 ppm and especially from 0.25 to 25 ppm, for example from 0.3 to 20 ppm, of at least one polar, oil-soluble nitrogen compound. The inventive mineral oil distillates more preferably comprise a total of up to 100 ppm, preferably from 0.2 to 70 ppm and especially from 0.3 to 50 ppm of the combination of alkylphenol-aldehyde resin or alkylphenol-aldehyde resins and polar, oil-soluble nitrogen compound or nitrogen compounds.

Preference is given to using from 0.2 to 100 ppm and especially from 0.25 to 25 ppm, for example from 0.3 to 10 ppm of at least one alkylphenol-aldehyde resin to improve the electrical conductivity of mineral oil distillates which comprise from 0.2 to 50 ppm and especially from 0.25 to 25 ppm, for example from 0.3 to 20 ppm, of at least one polar, oil-soluble compound.

The inventive mineral oil distillates having improved electrical conductivity have an electrical conductivity of preferably at least 60 pS/m, in particular at least 75 pS/m.

Alkylphenol-aldehyde resins as constituent I are known in principle and are described, for example, in Römpp Chemie Lexikon, 9th edition, Thieme Verlag 1988-92, volume 4, p. 3351 ff. Suitable in accordance with the invention are especially those alkylphenol-aldehyde resins, which derive from alkylphenols having one or two alkyl radicals in the ortho- and/or para-position to the OH group. Particularly preferred starting materials are alkylphenols, which bear, on the aromatic ring, at least two hydrogen atoms capable of condensation with aldehydes, and especially monoalkylated phenols. More preferably, the alkyl radical is in the para-position to the phenolic OH group. The alkyl radicals (for constituent I, this refers generally to hydrocarbon radicals as defined below) may be the same or different in the alkylphenol-aldehyde resins usable in the process according to the invention, they may be saturated or unsaturated and have up to 200, preferably 1-20, in particular 4-16, for example 6-12 carbon atoms; they are preferably n-, iso- and tert-butyl, n- and iso-pentyl, n- and iso-hexyl, n- and iso-octyl, n- and iso-nonyl, n- and iso-decyl, n- and iso-dodecyl, tetradecyl, hexadecyl, octadecyl, tripropenyl, tetrapropenyl, poly(propenyl)

and poly(isobutenyl) radicals. These radicals are preferably saturated. In a preferred embodiment, the alkylphenol resins are prepared by using mixtures of alkylphenols with different alkyl radicals. For example, resins based on butylphenol on the one hand and octyl-, nonyl- and/or dodecylphenol on the other in a molar ratio of from 1:10 to 10:1 have been found to be particularly useful.

Suitable alkylphenol resins may also contain structural units of further phenol analogs such as salicylic acid, hydroxybenzoic acid and derivatives thereof such as esters, amides and salts, or consist of them.

Suitable aldehydes for the alkylphenol-aldehyde resins are those having from 1 to 12 carbon atoms and preferably those having from 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of the alkylphenol-aldehyde resins determined by means of gel permeation chromatography in THF against poly(ethylene glycol) standards is preferably 400-20 000 g/mol, in particular 800-10 000 g/mol and especially 2000-5000 g/mol. A prerequisite here is that the alkylphenol-aldehyde resins are oil-soluble at least in concentrations relevant to the application of from 0.001 to 1% by weight.

In a preferred embodiment of the invention, the alkylphenol-formaldehyde resins contain oligo- or polymers having a repeat structural unit of the formula

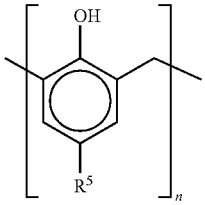

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100. $R^6$ is preferably $C_1$-$C_{20}$-alkyl or $C_2$-$C_{20}$-alkenyl and especially $C_4$-$C_{16}$-alkyl or -alkenyl, for example $C_6$-$C_{12}$-alkyl or -alkenyl. More preferably, $R^5$ is $C_1$-$C_{20}$-alkyl or $C_2$-$C_{20}$-alkenyl and especially $C_4$-$C_{16}$-alkyl or -alkenyl, for example $C_6$-$C_{12}$-alkyl or -alkenyl. n is preferably from 2 to 50 and especially from 3 to 25, for example from 5 to 15.

For use in middle distillates such as diesel and heating oil, particular preference is given to alkylphenol-aldehyde resins having $C_2$-$C_{40}$-alkyl radicals of the alkylphenol, preferably having $C_4$-$C_{20}$-alkyl radicals, for example $C_6$-$C_{12}$-alkyl radicals. The alkyl radicals may be linear or branched, they are preferably linear. Particularly suitable alkylphenol-aldehyde resins derive from alkylphenols having linear alkyl radicals having 8 and 9 carbon atoms. The mean molecular weight determined by means of GPC is preferably between 700 and 20 000, in particular between 1000 and 10 000, for example between 2000 and 3500 g/mol.

For use in gasoline and jet fuel, particular preference is given to alkylphenol-aldehyde resins, whose alkyl radicals bear from 4 to 200 carbon atoms, preferably from 10 to 180 carbon atoms, and derive from oligomers or polymers of olefins having from 2 to 6 carbon atoms, for example from poly(isobutylene). They are thus preferably branched. The degree of polymerization (n) here is preferably between 2 and 20, more preferably between 3 and 10 alkylphenol units.

These alkylphenol-aldehyde resins are obtainable by known processes, for example by condensation of the appropriate alkylphenols with formaldehyde, i.e. with from 0.5 to 1.5 mol, preferably from 0.8 to 1.2 mol of formaldehyde per mole of alkylphenol. The condensation can be effected without solvent, but is preferably effected in the presence of a water-immiscible or only partly water-miscible inert organic solvent such as mineral oil, alcohols, ethers and the like. Particular preference is given to solvents which can form azeotropes with water. Useful such solvents are especially aromatics such as toluene, xylene, diethylbenzene and relatively high-boiling commercial solvent mixtures, for example®Shellsol AB, and Solvent Naphtha. The condensation is effected preferably between 70 and 200° C., for example between 90 and 160° C. It is typically catalyzed by from 0.05 to 5% by weight of bases or preferably by from 0.05 to 5% by weight of acids. The catalysts used as acidic catalysts are, in addition to carboxylic acids such as acetic acid and oxalic acid, especially strong mineral acids such as hydrochloric acid, phosphoric acid, and sulfuric acid, and also sulfonic acids. Particularly suitable catalysts are sulfonic acids which contain at least one sulfonic acid group and at least one saturated or unsaturated, linear, branched and/or cyclic hydrocarbon radical having from 1 to 40 carbon atoms and preferably having from 3 to 24 carbon atoms. Particular preference is given to aromatic sulfonic acids, especially alkylaromatic monosulfonic acids having one or more $C_1$-$C_{28}$-alkyl radicals and especially those having $C_3$-$C_{22}$-alkyl radicals. Suitable examples are methanesulfonic acid, butanesulfonic acid, benzenesulfonic acid, p-toluenesulfonic acid, xylenesulfonic acid, 2-mesitylenesulfonic acid, 4-ethylbenzene sulfonic acid, isopropylbenzene sulfonic acid, 4-butylbenzene sulfonic acid, 4-octylbenzene sulfonic acid; dodecylbenzene sulfonic acid, didodecylbenzenesulfonic acid, naphthalenesulfonic acid. Mixtures of these sulfonic acids are also suitable. Typically, they remain in the product as such or in neutralized form after the reaction has ended; salts which contain metal ions and thus form ash are typically removed.

The polar oil-soluble nitrogen compounds suitable as constituent II in accordance with the invention are preferably reaction products of fatty amines with compounds which contain an acyl group. The preferred amines are compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A\text{-}O)_x\text{-}E$ or $—(CH_2)_n—NYZ$, where A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of 12/g, preferably less than 60 g of 12/g and in particular between 1 and 10 g of 12/9. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fat) amine. Preferred amine derivatives are amine salts, imides and/or amides, for example amide-ammonium salts of secondary fatty amines, in particular of dicoconut fatty amine, ditallow fatty amine and distearylamine. Particularly preferred polar oil-soluble nitrogen compounds as constituent II contain at least one acyl group converted to an ammonium salt. They especially contain at least two, for example at least three or at least four, and, in the case of polymeric nitrogen compounds, even five and more ammonium groups.

Acyl group refers here to a functional group of the following formula:

$$>C{=}O$$

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylene diaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which confer oil solubility on the copolymer. Oil-soluble means here that the copolymer, after reaction with the fatty amine, dissolves without residue in the mineral oil distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the carbon number is based on the alkyl radical attached to the double bond. Particularly suitable comonomers are olefins with terminal double bonds. The molecular weights of the polymeric carbonyl compounds are preferably between 500 and 50 000, more preferably between 1000 and 20 000, for example between 2000 and 10 000.

It has been found that oil-soluble polar nitrogen compounds which are obtained by reaction of aliphatic or aromatic amines, preferably long-chain aliphatic amines, with aliphatic or aromatic mono-, di-, tri- or tetracarboxylic acids or their anhydrides are particularly useful (cf. U.S. Pat. No. 4,211,534). Equally suitable as oil-soluble polar nitrogen compounds are amides and ammonium salts of aminoalkylenepolycarboxylic acids such as nitrilotriacetic acid or ethylenediaminetetraacetic acid with secondary amines (cf. EP 0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

Particularly preferred polar oil-soluble nitrogen compounds are reaction products of copolymers which derive from ethylenically unsaturated dicarboxylic acids and α-olefins with secondary fatty amines.

A further group of particularly preferred oil-soluble nitrogen compounds as constituent II is that of acylated nitrogen compounds which arise by reaction of mono- and also polycarboxylic acids having at least 10 carbon atoms or their reactive equivalents with amines which bear at least one acidic hydrogen atom. In this case, carboxylic acid and amine are joined to one another via amide, imide, amidine or ammonium carboxylate function.

Suitable mono- and polycarboxylic acids are, for example, substituted succinic acids and propionic acids, and their esters and anhydrides. The hydrocarbon radical, bonded to the acyl groups or acyl groups via a C—C bond, of these acylating agents bears up to 400, preferably from 30 to 50 carbon atoms. It is preferably an alkyl or alkenyl radical. It is preferably branched. It may contain one or two double bonds, but is preferably substantially saturated. It derives from olefins, for example dodecene, tetradecene, hexadecene, octadecene or eicosene, especially with terminal double bond, and preferably from homo- and copolymers of mono- and diolefins having from 2 to 6 carbon atoms such as ethylene, propylene, butene, isobutene, butadiene, isoprene and 1-hexene. Particularly preferred alkyl radicals are poly(isobutylenes). These are obtainable, for example, by polymerizing a $C_4$ refinery stream having a content of from 35 to 75% by weight of butene-1 and from 30 to 60% isobutene in the presence of a Lewis acid catalyst such as aluminum trichloride.

Suitable amino compounds for preparing the acylated nitrogen compounds are not only ammonia but also amines having alkyl radicals with up to 30 carbon atoms, polyamines of the formula $$(R^9)_2N\text{-}[A\text{-}N(R^9)]_q\text{—}(R^9)$$

in which each $R^9$ is independently hydrogen or an alkyl or hydroxyalkyl radical having up to 24 carbon atoms, but at least one $R^9$ is hydrogen, q is an integer from 1 to 10 and A is an alkylene radical having from 1 to 6 carbon atoms, and also polyamines and aromatic polyamines substituted by heterocycles. Particularly suitable mixtures are those of polyamines, typically mixtures of poly(ethyleneamines). Examples include: ethylenediamine, 1,2-propylenediamine, di(ethylene)triamine, tri(ethylene)tetramine, tetra(ethylene) pentamine, N-(2-hydroxyethyl)ethylenediamine, N, $N^{1}$-bis-(2-hydroxyethyl)ethylenediamine, N-(3-hydroxybutyl)tetra (methylene)diamine, N-2-aminoethylpiperazine, N-2- and N-3-aminopropylmorpholine, N-3-(dimethylamino)propylpiperazine, 2-heptyl-3-(2-aminopropyl)imidazoline, 1,4-bis (2-aminoethyl)piperazine, 1-(2-hydroxyethyl)piperazine, and also various isomers of phenylenediamine and of naphthalenediamine.

A typical and particularly preferred acylated nitrogen compound is obtainable by reaction of a poly(isobutylene)succinic anhydride or ester whose poly(isobutylene) radical bears between 50 and 400 carbon atoms with a mixture of poly(ethyleneamines) having from about 3 to 7 nitrogen atoms and from about 1 to 6 ethylene units.

Also suitable as polar oil-soluble nitrogen compounds are reaction products of unsaturated poly(isobutylenes) having from 50 to 400 carbon atoms with poly(ethyleneamines) having from about 3 to 7 carbon atoms and about 1-6 ethylene units, and also mixtures thereof.

For the purpose of simpler handling, the inventive compositions are preferably used as concentrates which contain from 10 to 90% by weight and preferably from 20 to 60% by weight, for example from 25 to 50% by weight, of solvent. Preferred solvents are relatively high-boiling aliphatic, aromatic hydrocarbons, alcohols, esters, ethers and mixtures thereof. In the concentrates, the mixing ratio between the inventive alkylphenol-aldehyde resins as constituent I and nitrogen compounds as constituent II may vary depending on the application. Such concentrates preferably contain from 0.1 to 10 parts by weight, preferably from 0.2 to 6 parts by weight, of the polar oil-soluble nitrogen compound per part by weight of alkylphenol-aldehyde resin.

The inventive compositions increase the conductivity of mineral oils such as gasoline, kerosene, jet fuel, diesel and heating oil, and they are especially advantageous in oils with low aromatics content of less than 21% by weight, in particular less than 19% by weight, especially less than 18% by weight, for example less than 17% by weight. Since they simultaneously improve the cold properties, especially of middle distillates such as kerosene, jet fuel, diesel and heating oil, their use in areas in which or at times at which no paraffin dispersants have been used to date owing to the climatic conditions allows a distinct saving in the overall additization of the oils, since there is no need to use any additional conductivity improvers. Since the inventive additives simultaneously improve the cold properties of the additized oils, it is additionally possible, for example, to set cloud point and/or CFPP of the oils to be additized to a higher level, which improves the economic viability of the refinery. The inventive additives additionally do not comprise any metals which might lead to ash in the course of combustion and thus to deposits in the combustion chamber or exhaust gas system and particle pollution of the environment.

To further increase the electrical conductivity of mineral oils, the inventive additives may also be used in combination with polysulfones. Suitable polysulfones are obtainable by copolymerization of sulfur dioxide with 1-olefins having from 6 to 20 carbon atoms, for example 1-dodecene. They have molecular weights, measured by means of GPC against poly(styrene) standards, of from 10 000 to 1 500 000, preferably from 50 000 to 900 000 and in particular from 100 000 to 500 000. The preparation of suitable polysulfones is known, for example, from U.S. Pat. No. 3,917,466.

The inventive additives may be added to mineral oil distillates in order to improve the cold flowability also in combination with further additives, for example ethylene copolymers, comb polymers, polyoxyalkylene compounds and/or olefin copolymers.

The present invention thus provides a novel additive package that, by means of the improvement of the cold properties, improves especially the antistatic properties of low-aromatics mineral oils.

In a preferred embodiment, the inventive additives for mineral oil distillates thus comprise, in addition to constituents I and II, also one or more of components III to VI.

For instance, they preferably comprise copolymers of ethylene and olefinically unsaturated compounds as constituent III. Suitable ethylene copolymers are especially those which, in addition to ethylene, contain from 6 to 21 mol %, in particular from 10 to 18 mol % of comonomers.

The olefinically unsaturated compounds are preferably vinyl esters, acrylic esters, methacrylic esters, alkyl vinyl ethers and/or alkenes, and the compounds mentioned may be substituted by hydroxyl groups. One or more of these comonomers may be present in the polymer.

The vinyl esters are preferably those of the formula 1

$$CH_2{=}CH{-}OCOR^1 \quad (1)$$

where $R^1$ is $C_2$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having from 7 to 11 carbon atoms, in particular having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and versatic esters such as vinyl neononanoate, vinyl neodecanoate, vinyl neoundecanoate.

In a further preferred embodiment, these ethylene copolymers contain vinyl acetate and at least one further vinyl ester of the formula 1 where $R^1$ is $C_4$- to $C_{30}$-alkyl, preferably $C_4$- to $C_{16}$-alkyl, especially $C_6$- to $C_{12}$-alkyl.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example, methyl(meth)acrylate, ethyl(meth)acrylate, propyl(meth)acrylate, n- and isobutyl(meth)acrylate, hexyl, octyl, 2-ethylhexyl, decyl, dodecyl, tetradecyl, hexadecyl, octadecyl (meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Particular preference is given to terpolymers, which, apart from ethylene, contain from 3.5 to 20 mol %, in particular from 8 to 15 mol % of vinyl acetate and from 0.1 to 12 mol %, in particular from 0.2 to 5 mol % of at least one relatively long-chain and preferably branched vinyl ester for example vinyl 2-ethylhexanoate, vinyl neononanoate or vinyl neodecanoate, the total comonomer content of the terpolymers preferably being between 8 and 21 mol %, preferably between 12 and 18 mol %. Further particularly preferred copolymers contain, in addition to ethylene and from 8 to 18 mol % of vinyl esters of $C_2$-$C_{12}$-carboxylic acids, also from 0.5 to 10 mol % of olefins such as propene, butene, isobutylene, hexene, 4-methylpentene, octene, diisobutylene and/or norbornene.

These ethylene co- and terpolymers preferably have melt viscosities at 140° C. of from 20 to 10 000 mPas, in particular from 30 to 5000 mPas, especially from 50 to 2000 mPas. The degrees of branching determined by means of $^1$H-NMR spectroscopy are preferably between 1 and 9 $CH_3$/100 $CH_2$ groups, in particular between 2 and 6 $CH_3$/100 $CH_2$ groups, which do not stem from the comonomers.

Preference is given to using mixtures of two or more of the abovementioned ethylene copolymers. More preferably, the parent polymers of the mixtures differ in at least one characteristic. For example, they may contain different comonomers, have different comonomer contents, molecular weights and/or degrees of branching.

The mixing ratio between the inventive additives and ethylene copolymers as constituent III may, depending on the application, vary within wide limits, the ethylene copolymers III often constituting the greater proportion. Such additive mixtures preferably contain from 2 to 70% by weight, preferably from 5 to 50% by weight of the inventive additive combination of 1 and 11, and from 30 to 98% by weight, preferably from 50 to 95% by weight of ethylene copolymers.

Suitable comb polymers (constituent IV) may be described, for example, by the formula

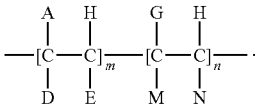

In this formula

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

Suitable comb polymers are, for example copolymers of ethylenically unsaturated dicarboxylic acids such as maleic acid or fumaric acid with other ethylenically unsaturated monomers such as olefins or vinyl esters, for example vinyl acetate. Particularly suitable olefins are α-olefins having from 10 to 24 carbon atoms, for example 1-decene, 1-dodecene, 1-tetradecene, 1-hexadecene, 1-octadecene and mixtures thereof. Also suitable as comonomers are longer-chain olefins based on oligomerized $C_2$-$C_6$-olefins, for example poly (isobutylene), having a high content of terminal double bonds. Typically, these copolymers are esterified to an extent of at least 50% with alcohols having from 10 to 22 carbon atoms. Suitable alcohols include n-decen-1-ol, n-dodecan-1-ol, n-tetradecan-1-ol, n-hexadecan-1-ol, n-octadecan-1-ol, n-eicosan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers), which derive from alcohols having 12 to 20 carbon atoms and poly(vinyl esters), which derive from fatty acids having from 12 to 20 carbon atoms.

Polyoxyalkylene compounds suitable as a further component (constituent V) are, for example, esters, ethers and ethers/esters of polyols, which bear at least one alkyl radical having from 12 to 30 carbon atoms. When the alkyl groups stem from an acid, the remainder stems from a polyhydric alcohol; when the alkyl radicals come from a fatty alcohol, the remainder of the compound stems from a polyacid.

Suitable polyols are polyethylene glycols, polypropylene glycols, polybutylene glycols and copolymers thereof having a molecular weight of from approx. 100 to approx. 5000, preferably from 200 to 2000. Also suitable are alkoxylates of polyols, for example of glycerol, trimethylolpropane, pentaerythritol, neopentyl glycol, and the oligomers which are obtainable therefrom by condensation and have from 2 to 10 monomer units, for example polyglycerol. Preferred alkoxylates are those having from 1 to 100 mol, in particular from 5 to 50 mol, of ethylene oxide, propylene oxide and/or butylene oxide per mole of polyol. Esters are particularly preferred.

Fatty acids having from 12 to 26 carbon atoms are preferred for the reaction with the polyols to form the ester additives, and particular preference is given to using $C_{18}$- to $C_{24}$-fatty acids, especially stearic and behenic acid. The esters may also be prepared by esterifying polyoxyalkylated alcohols. Preference is given to fully esterified polyoxyalkylated polyols having molecular weights of from 150 to 2000, preferably from 200 to 600. Particularly suitable are PEG-600 dibehenate and glycerol ethylene glycol tribehenate.

Suitable olefin copolymers (constituent VI) as further constituent of the additive according to the invention may derive directly from monoethylenically unsaturated monomers, or may be prepared indirectly by hydrogenation of polymers which derive from polyunsaturated monomers such as isoprene or butadiene. Preferred copolymers contain, in addition to ethylene, structural units which derive from α-olefins having from 3 to 24 carbon atoms and have molecular weights of up to 120 000 g/mol. Preferred α-olefins are propylene, butene, isobutene, n-hexene, isohexene, n-octene, isooctene, n-decene, isodecene. The comonomer content of α-olefins having 3 to 24 carbon atoms is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Preference is given to ethylene-propylene copolymers. The olefin copolymers may be prepared by known methods, for example by means of Ziegler or metallocene catalysts.

Further suitable olefin copolymers are block copolymers which contain blocks composed of olefinically unsaturated aromatic monomers A and blocks composed of hydrogenated polyolefins B. Particularly suitable block copolymers have the structure (AB)nA and (AB)m, where n is between 1 and 10 and m is between 2 and 10.

The additives may be used alone or else together with other additives, for example with other pour point depressants or dewaxing assistants, with antioxidants, cetane number improvers, dehazers, demulsifiers, detergents, dispersants, antifoams, dyes, corrosion inhibitors, lubricity additives, sludge inhibitors, odorants and/or additives for lowering the cloud point.

The mixing ratio between the inventive additive combinations composed of I and II and the further constituents V, VI and VII is generally in each case between 1:10 and 10:1, preferably in each case between 1:5 and 5:1.

The inventive additives are suitable for improving the electrostatic properties and the cold flow properties of animal, vegetable or mineral oils. In particular, they increase the electrical conductivity of the additized oils and thus enable safe handling, for example in the course of pumped transfer and shipping. At the same time, the conductivity of the oils additized in accordance with the invention does not decrease with falling temperature and, in many cases, a rise, unknown of prior art additives, in the conductivity with falling temperature was observed so that safe handling is ensured even at low ambient temperatures. A further advantage of the inventive additives is the retention of the electrical conductivity even over prolonged storage, i.e. for several weeks, of the additized oils. Furthermore, there are no incompatibilities between constituents I and II within the range of the mixing ratios suitable in accordance with the invention, so that, unlike the additives of U.S. Pat. No. 4,356,002 they can be formulated as concentrates without any problems.

They are particularly suitable for the improvement of the electrostatic properties of mineral oil distillates such as jet fuel, gasoline, kerosene, diesel and heating oil which have been subjected to refining under hydrogenating conditions for the purpose of lowering the sulfur content and therefore comprise only small proportions of polyaromatic and polar compounds. The inventive additives are particularly advantageous in mineral oil distillates which contain less than 350 ppm of sulfur, more preferably less than 100 ppm of sulfur, in particular less than 50 ppm of sulfur and, in special cases, less than 10 ppm of sulfur. They exhibit particular advantages in mineral oil distillates having a low aromatics content of less than 21% by weight, in particular less than 19% by weight, especially less than 18% by weight, for example less than 17% by weight. The water content of such oils is often below 150 ppm, in some cases below 100 ppm for example below 80 ppm. The electrical conductivity of such oils is typically below 10 pS/m and often even below 5 pS/m.

Particularly preferred mineral oil distillates are middle distillates. Middle distillates refer in particular to those mineral oils which are obtained by distillation of crude oil and boil in the range from 120 to 450° C., for example kerosene, jet fuel, diesel and heating oil. Their preferred sulfur, aromatics and water contents are as already specified above. The inventive compositions are particularly advantageous in those middle distillates which have 90% distillation points below 360° C., in particular 350° C. and in special cases below 340° C. Aromatic compounds are understood to mean the totality of mono-, di- and polycyclic aromatic compounds, as determinable by means of HPLC according to DIN EN 12916 (2001 edition). The middle distillates can also comprise minor amounts, for example up to 40% by volume, preferably from 1 to 20% by volume, especially from 2 to 15% by volume, for example from 3 to 10% by volume, of the oils of animal and/or vegetable origin described in detail below, for example fatty acid methyl esters.

The inventive compositions are likewise suitable for improving the electrostatic properties of fuels based on renewable raw materials (biofuels). Biofuels are understood to mean oils which are obtained from animal and preferably from vegetable material or both, and also derivatives thereof which can be used as fuel and especially as diesel or heating oil. They are especially triglycerides of fatty acids having from 10 to 24 carbon atoms, and also the fatty acid esters obtainable from them by transesterification of lower alcohols such as methanol or ethanol.

Examples of suitable biofuels are rapeseed oil, coriander oil, soya oil, cottonseed oil, sunflower oil, castor oil, olive oil, peanut oil, corn oil, almond oil, palm kernel oil, coconut oil, mustardseed oil, bovine tallow, bone oil, fish oils and used cooking oils. Further examples include oils which derive from wheat, jute, sesame, shea tree nut, arachis oil and linseed oil. The fatty acid alkyl esters also referred to as biodiesel may be derived from these oils by processes known in the prior art. Preference is given to rapeseed oil, which is a mixture of fatty acids esterified with glycerol, since it is obtainable in large amounts and is obtainable in a simple manner by extractive pressing of rapeseeds. In addition, preference is given to the likewise widely available oils of sunflowers and soya, and also to their mixtures with rapeseed oil.

Particularly suitable as biofuels are lower alkyl esters of fatty acids. Useful here are, for example, commercial mixtures of the ethyl, propyl, butyl and especially methyl esters of fatty acids having from 14 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid. Preferred esters have an iodine number of from 50 to 150 and in particular from 90 to 125. Mixtures having particularly advantageous properties are those which comprise mainly, i.e. to an extent of at least 50% by weight, methyl esters of fatty acids having from 16 to 22 carbon atoms and 1, 2 or 3 double bonds. The preferred lower alkyl esters of fatty acids are the methyl esters of oleic acid, linoleic acid, linolenic acid and erucic acid.

The inventive compositions are equally suitable for improving the electrostatic properties of turbine fuels. These are fuels which boil in the temperature range from about 65° C. to about 330° C. and are marketed, for example, under the designations JP-4, JP-5, JP-7, JP-8, Jet A and Jet A-1. JP-4 and JP-5 are specified in the U.S. Military Specification MIL-T-5624-N and JP-8 in the U.S. Military Specification MIL-T-83133-D; Jet A, Jet A-1 and Jet B are specified in ASTM D1655.

The inventive additives are equally suitable for improving the electrical conductivity of hydrocarbons which are used as a solvent, for example, in textile cleaning or for the production of paints and coatings.

EXAMPLES

Table 1: Characterization of Test Oils:

The test oils employed were oils from European refineries. The CFPP value was determined to EN 116 and the cloud point to ISO 3015. The aromatic hydrocarbon groups were determined to DIN EN 12916 (November 2001 edition)

| | | Test oil 1 | Test oil 2 | Test oil 3 (Comp.) |
|---|---|---|---|---|
| Distillation | | | | |
| IBP | [° C.] | 212 | 188 | 160 |
| 20% | [° C.] | 244 | 249 | 229 |
| 90% | [° C.] | 322 | 336 | 339 |
| FBP | [° C.] | 342 | 361 | 371 |
| Cloud point | [° C.] | −8.8 | −12.5 | 4.6 |
| Density @15° C. | [g/cm$^3$] | 0.8302 | 0.8264 | 0.8410 |
| Water content @20° C. | | 25 | 35 | 185 |
| Sulfur content | [ppm] | 4 | 6 | 173 |
| Electr. conductivity @25° C. | [pS/m] | 0 | 1 | 9 |
| Aromatics content | | 14.8 | 16.9 | 29.9 |
| of which | mono | 14.5 | 14.4 | 24.1 |
| | di | 0.3 | 2.4 | 5.3 |
| | poly | <0.1 | 0.1 | 0.5 |

The following additives were used:

(A) Characterization of the Alkylphenol Resins Used

A1 Acid-catalyzed nonylphenol-formaldehyde resin (Mw 1300 g/mol)

A2 Acid-catalyzed nonylphenol-formaldehyde resin (Mw 2200 g/mol)

A3 Acid-catalyzed dodecylphenol-formaldehyde resin (Mw 2600 g/mol)

A4 Alkali-catalyzed dodecylphenol-formaldehyde resin (Mw 2450 g/mol)

A5 Alkylphenol-formaldehyde resin prepared under acid catalysis from equimolar proportions of nonylphenol and butylphenol (Mw 2900 g/mol)

A6 Nonylphenol resin alkoxylated with 5 mol of ethylene oxide per phenolic OH group as per A2 (comparison).

(B) Characterization of Nitrogen Compounds B Used

B1 Reaction products of a dodecenyl-spiro-bislactone with a mixture of primary and secondary tallow fat amine, prepared according to EP 0413279.

B2 Reaction product of a terpolymer of $C_{14/16}$-α-Olefin, maleic anhydride and allyl polyglycol with 2 equivalents of ditallow fat amine, prepared according to EP 0606055.

B3 Reaction product of phthalic anhydride and 2 equivalents of di(hydrogenated tallow fat)amine, prepared according to EP 0 061 894.

B4 Reaction products of ethylenediaminetetraacetic acid with 4 equivalents of ditallow fat amine to the amide-ammonium salt, prepared according to EP 0 398 101.

B5 Reaction product of poly(isobutenyl)succinic anhydride and tetraethylenepentamine.

The molecular weights were determined by means of gel permeation chromatography in THF against poly(ethylene glycol) standards. The additives A and B were used at 50% dilutions in Solvent Naphtha, a commercial mixture of high-boiling aromatic hydrocarbons.

Improvement of the electrical conductivity of middle distillates

For conductivity measurements, the additives with the concentrations specified in each case were dissolved in 250 ml of test oil 1 with shaking. A Maihak SLA 900 automatic conductivity meter was used to determine the electrical conductivity therein to DIN 51412-T02-79. The unit for the electrical conductivity is picosiemens/m (pS/m). For jet fuel, a conductivity of at least 50 pS/m is generally specified. The dosages specified are each based on the amounts of active substance used.

TABLE 2

Electrical conductivity in test oil 1

| | Additive A | | Additive B | | Conductivity [pS/m] | |
|---|---|---|---|---|---|---|
| Ex. No. | dosage | | dosage | | @ 25° C. | @ 10° C. |
| 1 (comp.) | 25 ppm | A1 | — | — | 3 | 2 |
| 2 (comp.) | 50 ppm | A1 | — | — | 3 | 2 |
| 3 (comp.) | 10 ppm | A2 | — | — | 1 | 1 |
| 4 (comp.) | 25 ppm | A2 | — | — | 3 | 1 |
| 5 (comp.) | 50 ppm | A2 | — | — | 4 | 2 |
| 6 (comp.) | 50 ppm | A3 | — | — | 4 | 3 |
| 7 (comp.) | 50 ppm | A4 | — | — | 5 | 3 |
| 8 (comp.) | 25 ppm | A6 | — | — | 3 | 1 |
| 9 (comp.) | — | — | 10 ppm | B2 | 3 | 2 |
| 10 (comp.) | — | — | 25 ppm | B2 | 3 | 2 |
| 11 (comp.) | — | — | 50 ppm | B2 | 8 | 5 |
| 12 (comp.) | — | — | 10 ppm | B3 | 1 | 1 |
| 13 (comp.) | — | — | 25 ppm | B3 | 2 | 2 |
| 14 (comp.) | — | — | 50 ppm | B3 | 4 | 4 |
| 15 (comp.) | — | — | 10 ppm | B4 | 3 | 2 |
| 16 (comp.) | — | — | 25 ppm | B4 | 5 | 4 |
| 17 (comp.) | — | — | 50 ppm | B4 | 7 | 5 |
| 18 (comp.) | — | — | 25 ppm | B5 | 4 | 3 |
| 19 | 7 ppm | A2 | 3 ppm | B2 | 44 | 57 |
| 20 | 3 ppm | A2 | 7 ppm | B2 | 57 | 68 |

TABLE 2-continued

Electrical conductivity in test oil 1

| | Additive A | | Additive B | | Conductivity [pS/m] | |
|---|---|---|---|---|---|---|
| Ex. No. | dosage | | dosage | | @ 25° C. | @ 10° C. |
| 21 | 16 ppm | A2 | 8 ppm | B2 | 120 | 204 |
| 22 | 8 ppm | A2 | 16 ppm | B2 | 141 | 225 |
| 23 | 15 ppm | A2 | 35 ppm | B2 | 341 | 615 |
| 24 | 8 ppm | A1 | 16 ppm | B2 | 110 | 161 |
| 25 | 16 ppm | A1 | 8 ppm | B2 | 99 | 126 |
| 26 | 8 ppm | A2 | 16 ppm | B3 | 77 | 94 |
| 27 | 15 ppm | A2 | 15 ppm | B3 | 136 | 147 |
| 28 | 10 ppm | A2 | 15 ppm | B4 | 64 | 71 |
| 29 | 15 ppm | A2 | 7 ppm | B4 | 77 | 82 |
| 30 | 8 ppm | A2 | 16 ppm | B5 | 110 | 130 |
| 31 | 5 ppm | A3 | 10 ppm | B2 | 125 | 196 |
| 32 | 5 ppm | A4 | 10 ppm | B2 | 115 | 126 |
| 33 (comp.) | 8 ppm | A6 | 16 ppm | B2 | 24 | 18 |

Example 34

When the composition according to example 22 was cooled further to 0° C., a conductivity of 353 pS/m was measured.

TABLE 3

Electrical conductivity in test oil 2

| | Additive A | | Additive B | | Conductvity [pS/m] | |
|---|---|---|---|---|---|---|
| Ex. No. | dosage | | dosage | | @ 25° C. | @ 10° C. |
| 35 (comp.) | 25 ppm | A1 | — | — | 1 | 0 |
| 36 (comp.) | 10 ppm | A2 | — | — | 2 | 0 |
| 37 (comp.) | 25 ppm | A2 | — | — | 4 | 2 |
| 38 (comp.) | 25 ppm | A5 | — | — | 3 | 1 |
| 39 (comp.) | 25 ppm | A6 | — | — | 2 | 1 |
| 40 (comp.) | — | — | 25 ppm | B1 | 3 | 1 |
| 41 (comp.) | — | — | 10 ppm | B2 | 2 | 2 |
| 42 (comp.) | — | — | 25 ppm | B2 | 6 | 3 |
| 43 (comp.) | — | — | 25 ppm | B5 | 4 | 2 |
| 44 | 10 ppm | A1 | 15 ppm | B1 | 109 | 132 |
| 45 | 16 ppm | A1 | 8 ppm | B2 | 170 | 243 |
| 46 | 8 ppm | A2 | 16 ppm | B2 | 268 | 430 |
| 47 | 15 ppm | A2 | 35 ppm | B2 | 461 | 890 |
| 48 | 8 ppm | A5 | 16 ppm | B2 | 279 | 415 |
| 49 | 10 ppm | A3 | 10 ppm | B5 | 252 | 337 |
| 50 (comp.) | 10 ppm | A6 | 5 ppm | B2 | 24 | 16 |
| 51 (comp.) | 8 ppm | A6 | 16 ppm | B2 | 54 | 38 |

TABLE 4

Electrical conductivity in test oil 3 (comparison)

| | Additive A | | Additive B | | Conductivity [pS/m] | |
|---|---|---|---|---|---|---|
| Ex. No. | dosage | | dosage | | @ 25° C. | @ 10° C. |
| 52 | 10 ppm | A2 | — | — | 19 | 12 |
| 54 | 10 ppm | A4 | — | — | 26 | 17 |
| 55 | 10 ppm | A6 | — | — | 25 | 18 |
| 57 | — | — | 3 ppm | B2 | 41 | 24 |
| 59 | 10 ppm | A2 | 3 ppm | B2 | 105 | 73 |
| 60 | 10 ppm | A4 | 3 ppm | B2 | 97 | 66 |
| 61 | 10 ppm | A6 | 3 ppm | B2 | 160 | 102 |

The examples show that the inventive compositions have a marked synergistic effect compared to the individual components. In addition, they show that the inventive compositions increase the electrical conductivity, especially of low-aromatics fuel oils with low water content, to a greater extent than the known prior art additives. The conductivity of the mineral oil distillates additized in accordance with the invention rises with falling temperature. Since the additives used are additionally known to bring about improved paraffin dispersancy, comparable conductivity can be achieved with lower additive dosage of conventional additives. A further advantage of the invention is that the inventive additives, in addition to the improvement in the conductivity, simultaneously improve the cold properties, which allows the manufacturer of the fuel oil to process a higher proportion of paraffin-rich distillation cuts which are problematic under cold conditions.

What is claimed is:

1. A method for improving the electrical conductivity of a mineral oil distillate having a water content of less than 150 ppm, the mineral oil distillate being selected from the group consisting of jet fuel, gasoline, kerosene, diesel oil, heating oil, the mineral oil distillate having an electrical conductivity of below 10 pS/m, wherein the method comprises the step of adding to the mineral oil distillate a composition which comprises at least one alkylphenol-aldehyde resin (constituent I) which has a structural element of the formula

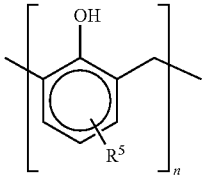

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and, from 0.1 to 10 parts by weight of at least one polar oil-soluble nitrogen compound (constituent II), based on the alkylphenol-aldehyde resin in such an amount that the mineral oil distillate has a conductivity of at least 50 pS/m.

2. A method of claim 1, wherein the aldehyde used for the condensation of the alkylphenol-aldehyde resin comprises from 1 to 12 carbon atoms.

3. A method of claim 1, wherein the alkylphenol-aldehyde resin comprises an alkyl group of from 1 to 200 carbon atoms.

4. A method of claim 1, wherein the alkylphenol-aldehyde resin has a molecular weight of from 400 to 20 000 g/mol.

5. A method of claim 1, wherein the alkylphenol-aldehyde resin comprises the repeat structural unit of the formula

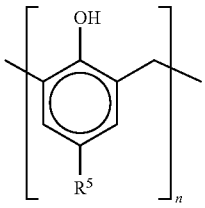

wherein $R^5$ is $C_1$-$C_{200}$-alkyl or $C_2$-$C_{200}$-alkenyl and n is from 2 to 100.

6. A method of claim 1, wherein the polar oil-soluble nitrogen compound comprises a reaction product of a compound of the formula $NR^6R^7R^8$ in which $R^6$, $R^7$ and $R^8$ may be the same or different, and at least one of $R^6$, $R^7$ and $R^8$ is $C_8$-$C_{36}$-alkyl, $C_6$-$C_{36}$-cycloalkyl, $C_8$-$C_{36}$-alkenyl, and the remaining $R^6$, $R^7$ and $R^8$ are either hydrogen, $C_1$-$C_{36}$-alkyl, $C_2$-$C_{36}$-alkenyl, cyclohexyl, or a group of the formulae -$(A\text{-}O)_x$-E or -$(CH_2)_n$—NYZ, wherein A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or -$(A\text{-}O)_x$, with compounds which include a functional group of the formula

>C=O.

7. A method as claimed in claim 6, wherein the compound of the formula $NR^6R^7R^8$ is reacted with a carbonyl compound which is a copolymer of a first compound selected from the group consisting of acrylic acid, methacrylic acid, maleic acid, fumaric acid, and itaconic acid with a second compound selected from the group consisting of olefins, alkyl esters of acrylic acid, alkyl esters of methacrylic acid, alkyl vinyl esters, and alkyl vinyl ethers having from 2 to 75 carbon atoms in the alkyl radical, wherein the olefins have from 2 to 75 carbon atoms and the alkyl radical is bonded to the double bond, the copolymer having a molecular weight being between 400 and 20 000.

8. A method of claim 6, wherein the polar nitrogen compound is a reaction product of at least one mono-carboxylic acid or a polycarboxylic acid or a mixture thereof and at least one amine which has at least one acidic hydrogen atom.

9. A method of claim 1, further comprising a copolymer of ethylene and from 6 to 21 mol % of a compound selected from the group consisting of a vinyl ester, an acrylic ester, a methacrylic ester, an alkyl vinyl ester, an alkene, and mixtures thereof.

10. A method of claim 1, further comprising a comb polymer of the formula

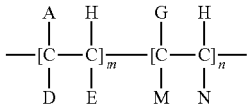

wherein

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR", an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

11. A method of claim 1, further comprising a polyoxyalkylene compound selected from the group consisting of an ester, an ether, and an ether/ester having at least one alkyl radical having 12 to 30 carbon atoms.

12. A method of claim 1, further comprising a copolymer which, in addition to structural units of ethylene, have a structural unit derived from an α-olefin having from 3 to 24 carbon atoms, said copolymer having a molecular weight of up to 120 000 g/mol.

13. A method of claim 1, further comprising a polysulfone derived from an olefin having from 6 to 20 carbon atoms.

14. A process for improving the electrical conductivity of mineral oil distillate having a water content of less than 150 ppm, the mineral oil distillate being selected from the group consisting of jet fuel, gasoline, kerosene, diesel oil, heating oil, the mineral oil distillate having an electrical conductivity of below 10 pS/m, and comprising from 0.1 to 200 ppm of at least one polar, oil-soluble nitrogen compound, said process comprising adding to the mineral oil distillate from 0.1 to 200 ppm of at least one alkylphenol-aldehyde resin which has a structural element of the formula

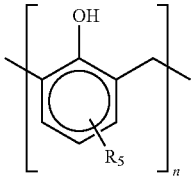

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl and n is from 2 to 100, so that the mineral oil distillate has a conductivity of at least 50 pS/m.

15. A process for improving the electrical conductivity of a mineral oil distillate having a water content of less than 150 ppm, the mineral oil distillate being selected from the group consisting of jet fuel, gasoline, kerosene, diesel oil, heating oil, the mineral oil distillate having an electrical conductivity of below 10 pS/m, and comprising from 0.1 to 200 ppm of at least one polar, oil-soluble nitrogen compound (constituent II), wherein the process comprises adding to the mineral oil distillate at least one alkylphenol-aldehyde resin (constituent I) which contains a structural element of the formula

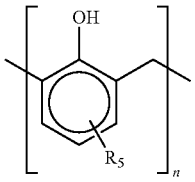

wherein $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, in an effective amount that the mineral oil distillate has a conductivity of at least 50 pS/m.

16. A mineral oil distillate having an aromatics content of less than 21% by weight, a water content of less than 150 ppm and a conductivity of at least 50 pS/m, the mineral oil distillate being selected from the group consisting of jet fuel, gasoline, kerosene, diesel oil, heating oil, the mineral oil distillate having an electrical conductivity of below 10 pS/m, and comprising from 0.1 to 200 ppm of at least one alkylphenol-aldehyde resin (constituent I) which contains a structural element of the formula

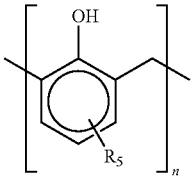

wherein $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl and n is from 2 to 100, and from 0.1 to 200 ppm of at least one polar oil-soluble nitrogen compound (constituent II).

17. A method of claim 6, wherein at least one of $R^6$, $R^7$ and $R^8$ is $C_{12}$-$C_{24}$-alkyl, $C_{12}$-$C_{24}$-alkenyl or cyclohexyl.

* * * * *